United States Patent [19]

Gage et al.

[11] Patent Number: 4,911,666

[45] Date of Patent: Mar. 27, 1990

[54] BOAT PROPULSION DEVICE WITH INTERNAL EXHAUST

[75] Inventors: Roger A. Gage, Marysville, Wash.; David J. Gruenwald, Hartford; Bryan L. Danner, West Bend, both of Wis.

[73] Assignee: US Marine Corporation, Hartford, Wis.

[21] Appl. No.: 62,453

[22] Filed: Jun. 15, 1987

[51] Int. Cl.[4] ..... B63H 21/32

[52] U.S. Cl. ..... 440/89; 440/112

[58] Field of Search ..... 440/53-65, 440/75, 88, 89, 111, 112

[56] References Cited

U.S. PATENT DOCUMENTS

| | | | |
|---|---|---|---|
| 1,011,930 | 12/1911 | Evinrude . | |
| 1,824,213 | 9/1931 | Johnson | 440/59 |
| 1,900,180 | 3/1933 | Harvey . | |
| 1,911,192 | 5/1933 | Harvey . | |
| 2,064,463 | 12/1936 | Crosley, Jr. . | |
| 2,209,302 | 7/1940 | Johnson et al. | 440/53 |
| 2,633,817 | 4/1953 | Pedranti . | |
| 2,948,252 | 8/1960 | Alexander . | |
| 2,976,836 | 3/1961 | Fageol | 440/112 |
| 3,029,769 | 4/1962 | Kiekhaefer . | |
| 3,164,122 | 1/1965 | Fageol . | |
| 3,170,436 | 2/1965 | Deutch . | |
| 3,659,547 | 5/1972 | Stuart . | |
| 3,752,111 | 8/1973 | Meynier, Jr. . | |
| 3,865,068 | 2/1975 | Haasl | 440/112 |
| 4,371,348 | 2/1983 | Blanchard | 440/52 |
| 4,543,069 | 9/1985 | Kobayashi | 440/112 |

*Primary Examiner*—Joseph F. Peters, Jr.
*Assistant Examiner*—Jesûs D. Sotelo
*Attorney, Agent, or Firm*—Lewis L. Lloyd

[57] ABSTRACT

A marine drive which mounts through a hole in the bottom surface of a boat utilizes a driveshaft housing assembly, an engine mounted to the driveshaft assembly and a lower propeller drive unit mounted to the driveshaft housing assembly. The driveshaft housing assembly which mounts the drive within the hole in the boat includes a driveshaft housing, a steering assembly constructed to rotate about a generally vertical axis within said driveshaft housing assembly to provide steering, a trimming assembly connected to the steering assembly to pivotably swing the lower propeller drive unit to provide trimming/tilting, a driveshaft and an exhaust passageway therethrough.

12 Claims, 5 Drawing Sheets

BOAT PROPULSION DEVICE WITH INTERNAL EXHAUST

BACKGROUND OF THE INVENTION

This application is related to the following application titled: L-Drive Ser. No. 062,244; Boat Propulsion Device; Exhaust System for a Boat Propulsion Device Ser. No. 062,449; Boat with Cavity for a Boat Propulsion Device Ser. No. 062,459; and Driveshaft Housing for a Boat Propulsion Device Ser. No. 062,228, all filed concurrent herewith on June 15, 1987.

The field of the present invention is a boat propulsion device and more particularly concerns a boat propulsion device with an internal exhaust system.

In one prior marine drive described in U.S. Pat. Nos. 2,976,836 and 3,164,122, issued to L. J. Fageol et al, the exhaust system is not internal to the drive, but passes from the engine directly out of the boat. Although satisfactory exhaust is achieved, the unpleasant exhaust odor may linger adjacent the boat.

SUMMARY OF THE INVENTION

The present invention is directed to a boat propulsion device having an internal exhaust passageway connecting between an engine inside a boat and a drive having an independently steerable and trimmable lower unit under and extending to the rear of the boat. The internal exhaust system is self contained to the boat propulsion device. This provides installation cost savings since it eliminates the separate exhaust connection through the boat and it permits use on boats having different bottom shapes without compromising the boat shape or positioning of the device to connect the exhaust.

The boat propulsion device of the invention includes a downward exhaust from the engine through an unique driveshaft housing within an exhaust passageway surrounding a driveshaft, further downward through a connecting internal passageway within the lower unit and out from the lower unit. In one embodiment, the exhaust gases exhaust through the propeller hub, and in another embodiment the exhaust gases exit the lower unit under the anticavitation plate. These embodiments deposit the exhaust gas rearwardly from the boat into the water to prevent lingering of exhaust gas odors. Furthermore, engine exhaust noise is substantially reduced.

The exhaust passageway surrounding the driveshaft achieves significant advantages of compactness and low cost while also accommodating bending of the driveshaft at the flexible coupling for trim/tilt power rotation of the vertical driveshaft and steering about the vertical driveshaft axis. These advantages of compactness and low cost are achieved with simplified structure and components that accommodate the continuous flow of hot exhaust gases.

DETAILED DESCRIPTION OF THE PREFERRED EMBODIMENT

L-Drive

Figure 1:
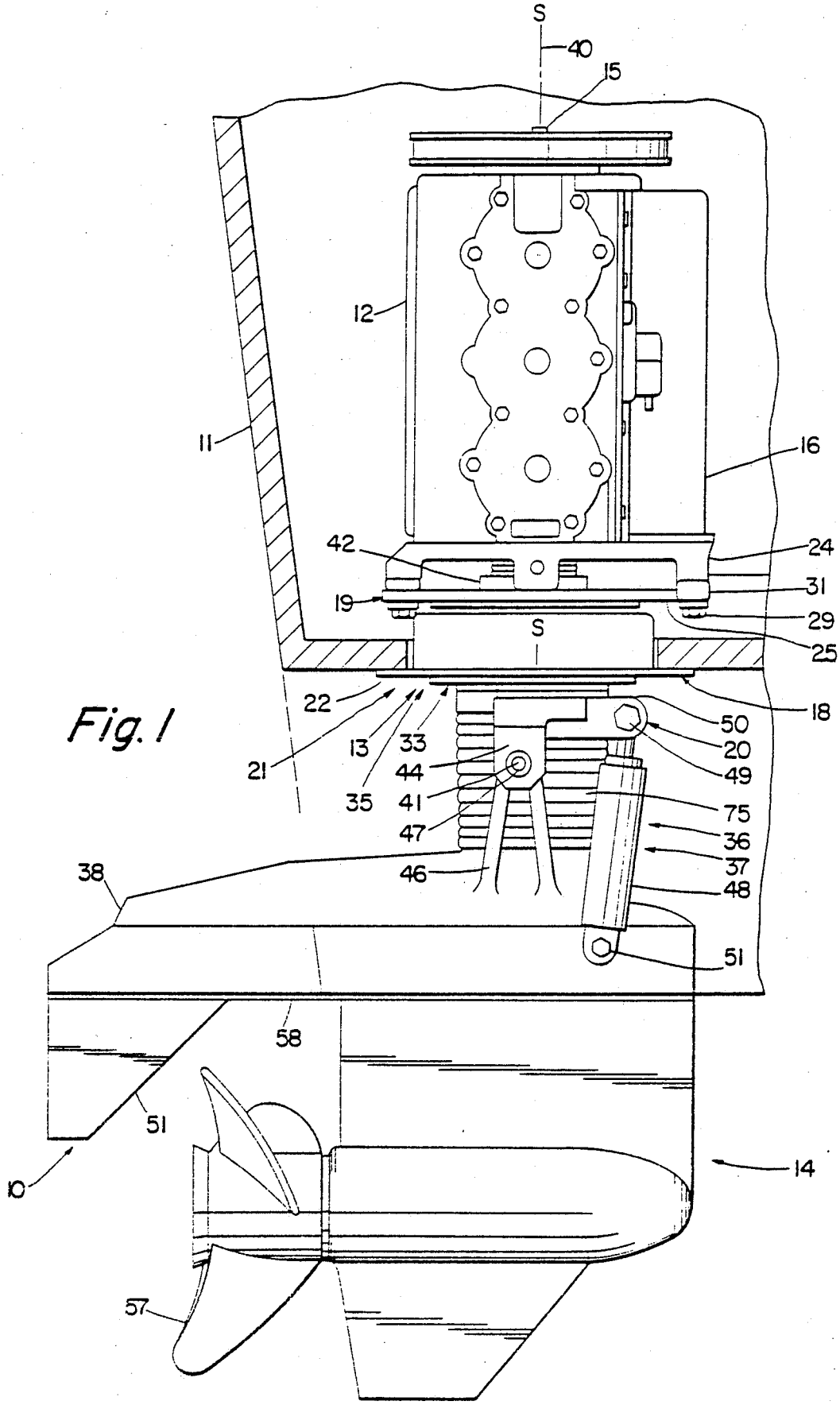
FIG. 1 is a right side elevational view of the boat propulsion device of the invention.
Figure 2:
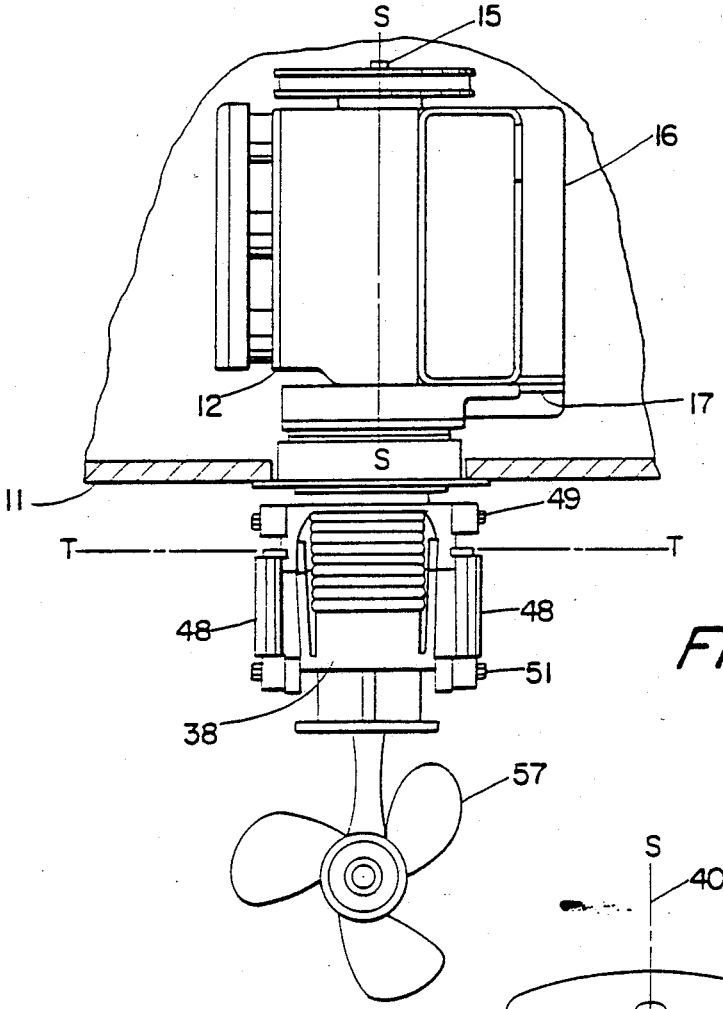
FIG. 2 is a back elevational view of the boat propulsion device of FIG. 1.
Figure 3:
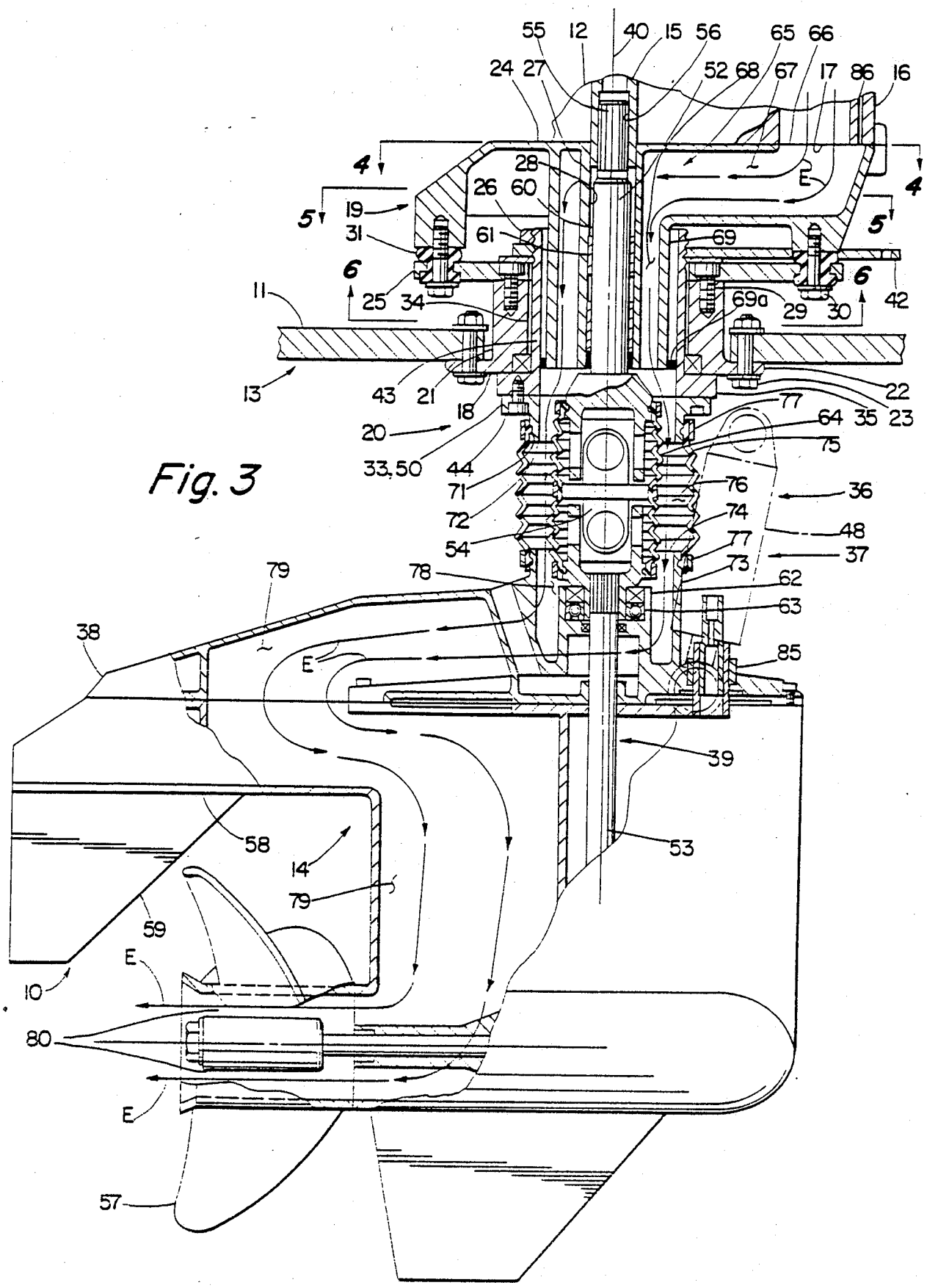
FIG. 3 is a partial cross sectional view of the boat propulsion device of FIG. 1.

A boat propulsion device or L-Drive 10 is shown mounted on a water craft or boat 11 in FIGS. 1 through 3 The boat propulsion device 10 includes an engine 12, a driveshaft housing assembly 13 and a propeller drive or lower unit 14.

The engine 12 may be of either a 2 or 4 cycle internal combustion type. The preferred embodiment uses the eighty five horsepower engine of the U.S. Marine Force outboard. For increased horsepower, the one hundred twenty five horsepower U.S. Marine Force outboard engine may be used. The engine 12 is prevented from movement by attachment to the midsection or driveshaft housing assembly 13. The engine 12 includes a crankshaft 15 and an exhaust chest or exhaust manifold 16. The engine 12 is oriented in the boat 11 with the crankshaft 15 on a vertical axis 40 and connected for power transmission as will be described.

The driveshaft housing assembly 13 as shown in FIGS. 3 through 6 provides a boat mounting portion 18 for attachment of the driveshaft housing assembly 13 to the boat 11, an engine mounting portion 19 for attachment of the engine 12 and connection of the engine exhaust manifold 16, and a drive mounting portion 20 for attachment of the propeller drive or lower unit 14 to the driveshaft housing assembly 13.

The boat mounting portion 18 includes a spindle housing 21. The spindle housing 21 includes a flange 22 for attachment to the boat 11 with flange bolts 23.

The engine mounting portion 19 includes an engine support housing 24 and an intermediate plate 25. An engine adapter plate, (not shown) is required to utilize the alternate one hundred twenty five horsepower engine. The engine support housing 24 includes a driveshaft housing portion 27 extending downward within the spindle housing 21. The driveshaft housing portion 27 contains a central bore 28 for a driveshaft as will be described. The intermediate plate 25 attaches with intermediate plate mounting bolts 29 to the drive mounting portion 20 and to the engine support housing 24 with engine support housling bolts 30. Resilient members 31 positioned on the engine support housing bolts 30 provide vibration isolation.

The drive mounting portion 20 is the spindle 33 which is rotatably supported in a long bushing 34 in the spindle housing 21 as shown in FIG. 3.

Included within the driveshaft housing assembly 13, as shown in FIGS. 3 through 6, is a steering assembly 35, a trimming assembly 36 with a trim adjusting system 37, a lower unit adapter 38, and a driveshaft means 39. The steering assembly 35 provides rotation of the lower unit 14 about a vertical axis 40 or S-S in the driveshaft housing assembly 13 to steer and the trimming assembly 36 provides pivoting up-and-down about a horizontal axis 41 or T-T to trim/tilt.

The steering assembly 35 includes a steering arm 42 for rotating the spindle 33 to steer the boat 11. The spindle 33, shown in FIGS. 3 and 5, includes an upper generally tubular portion or hollow spindle portion 43 which extends up through the spindle housing 21 to a position within the engine mounting portion 19.

Figure 5:
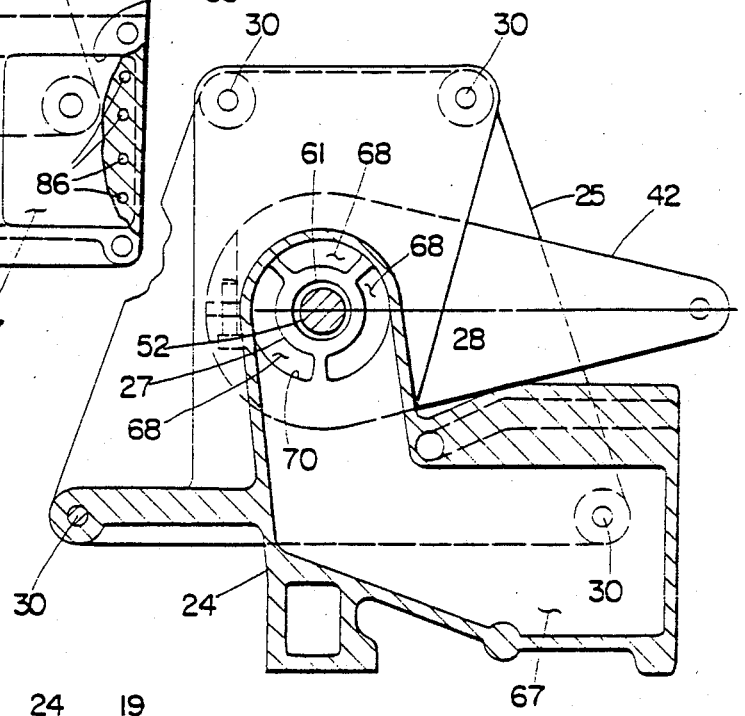
FIG. 5 is a downward cross sectional view on line 5—5 of a portion of the boat propulsion device of FIG. 3.

The steering arm 42 is attached to the top of the spindle portion 43 with a key or spline (not shown) so that they rotate as one unit. The steering arm 42 extends out generally horizontal from the spindle 33 within the engine mounting portion 19 between two of the engine support housing bolts 30 as shown in FIG. 5. The two engine support housing bolts 30 are positioned spaced to provide a rotational steering range for the steering arm 42. The steering arm 42 is connected with a boat steering system which rotates the spindle 33 to steer the lower unit 14. A locking spindle nut 26 is positioned on top of the steering arm 42 to retain the spindle 33.

The steering assembly 35 also includes a yoke or downward trunnion 44 which contains the horizontal trimming axis 41 for the trimming assembly 36.

The trimming assembly 36 includes an upward trunnion 46 on the lower unit adapter 38 which pivotally mounts the adapter 38 to the downward trunnion 44 on the spindle 33 at trimming axis 41. The overlapping or engaging sides of the trunnions 44 and 46 each contain a pivot pin 47. The trimming assembly 36 also utilizes a trim adjusting system 37 which includes a hydraulic trim cylinder 48 on each side of the lower unit 14 connected between a cylinder upper pivot 49 on the lower portion 50 of the spindle 33 and a cylinder lower pivot 51 on the lower unit 14. Operation of the hydraulic trim cylinder 48 pivots the lower unit 14 up-and-down about aligned pivot pins 47 for trim/tilt. Although two hydraulic trim cylinders 48 are shown, one cylinder may be used.

The driveshaft means 39 includes a first or upper vertical driveshaft 52, a second or lower driveshaft 53, and a flexible coupling or constant velocity universal joint 54 connecting adjacent ends of the drive shafts 52 and 53 as shown in FIG. 3. The upper driveshaft 52 is between the engine crankshaft 15 and the trimming pivot 45 and the lower driveshaft 53 is between the trimming pivot 45 and the lower unit 14 attaching to the loer unit gearing (not shown) as is known. The upper driveshaft 52 includes an external spline 55 which slidably engages the internal spline 56 in the crankshaft 15.

The lower unit adapter 38, as shown in FIG. 3, mounts to the top of the lower unit 14 to detachably interface or adapt from the lower unit 14 to the driveshaft housing assembly 13.

The lower unit 14 as shown in FIGS. 1 through 3 includes the exhaust-through-the-hub propeller 57, a propeller shaft including reversing clutch and gearing (not shown), an anticavitation plate 58 and a trim fin 59 under the anticavitation plate 58.

The lower driveshaft 53 is generally vertical when the propeller shaft is horizontal. The upper driveshaft 52 is positioned on the vertical axis S-S. The lower driveshaft 53 angles down from the upper driveshaft 52 at the universal joint 54 during trim/tilt. The upper and lower drive shafts 52 and 53 are coplanar with a plane that is perpendicular to the axis T-T of the trimming pivot 45.

The driveshaft housing portion 27 forms an upper bearing support 60 extending downward from the engine mounting portion 19. The upper bearing support 60 extends downward from the engine support housing 24 to the universal joint 54. The lower end of the upper bearing support 60 contains an upper shaft bearing 61 positioned adjacent the universal joint 54 for support of the upper driveshaft 52. The upper shaft bearing 61 aligns the upper driveshaft 52 with the crankshaft 15.

A driveshaft lower bearing support 62 is also provided as a hollow member extending upward from the lower unit adapter 38 into the space between the upward trunnion 46 and the lower driveshaft 53. The upper end of the lower bearing support 62 contains a lower shaft bearing 63 positioned adjacent the universal joint 54 for support of the lower driveshaft 53.

The steering assembly 35 and trimming assembly 36 generally include a closed compartment or universal joint bellows 64 around the universal joint 54. The bellows 64 may also enclose a portion or all of the upper and lower drive shafts 52 and 53. The bellows 64 is sealably attached over the universal joint 54 as shown in FIG. 3. The universal joint bellows 63 is between the spindle 33 and the lower unit adapter 38 and is part of the driveshaft housing assembly 13.

The L-Drive 10 also includes a self-contained interval exhaust system 65. The exhause system 65 provides a continuous closed exhause passage from the engine exhaust manifold 16 through the driveshaft housing assembly 13, lower unit adapter 38, into the lower unit 14 and out through the propeller 57 as shown in FIGS. 1 and 3.

Figure 4:
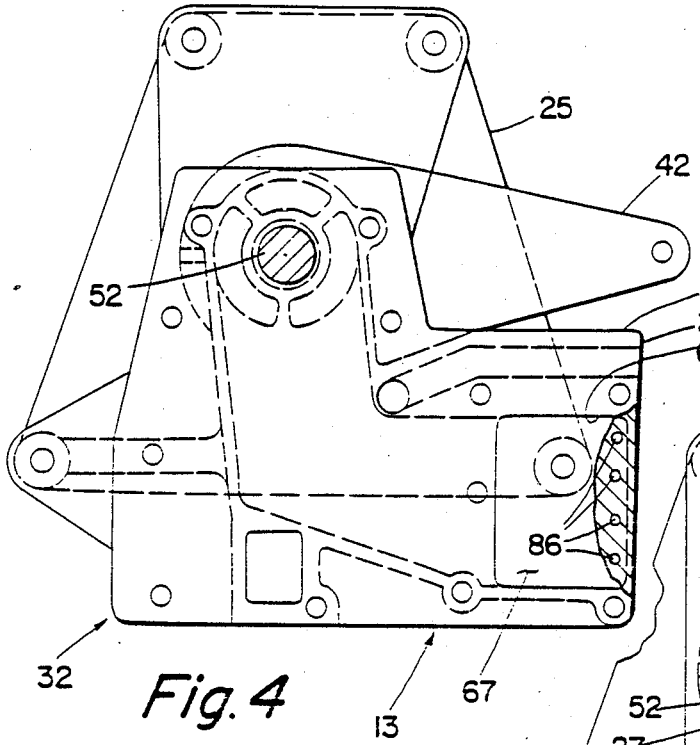
FIG. 4 is a downward view on line 4—4 of a portion of the boat propulsion device of FIG. 3.
Figure 6:
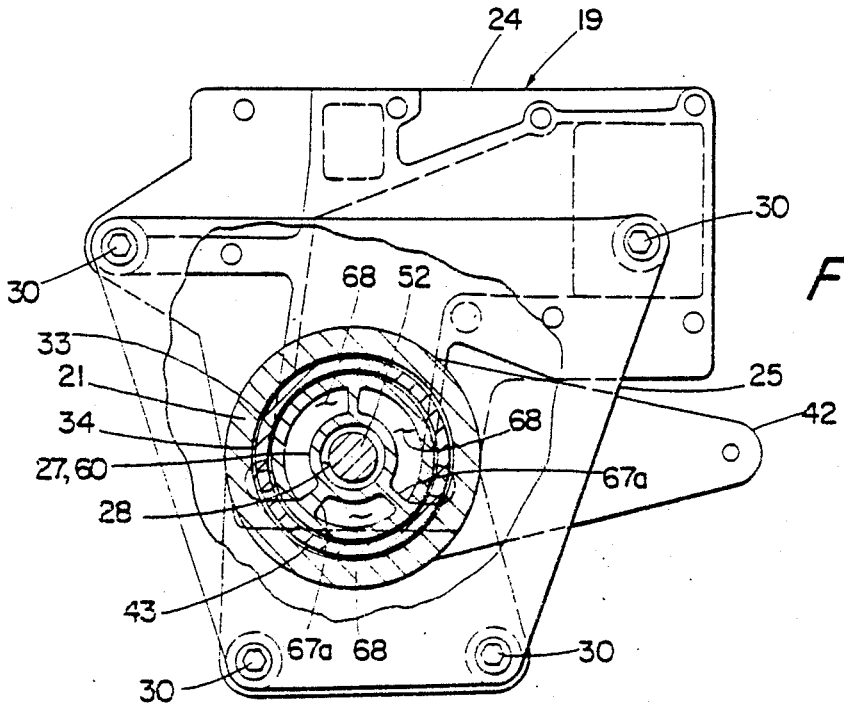
FIG. 6 is an upward cross sectional view on line 6—6 of a portion of the boat propulsion device of FIG. 3.

The downwardly directing exhaust outlet 17 from the engine exhaust manifold 16 connects to an exhaust inlet 66 in the engine support housing 24. The exhaust manifold 16 is shown in FIG. 3 facing towards the boat bow. It may be oriented towards the sides or transom of the boat 11 by rotation of the engine 12 and driveshaft housing assembly 13 within the boat. The exhaust inlet 66 opens into a first exhaust chamber 67 within a portion of the engine support housing 24 as shown in FIGS. 3 and 4. The first exhaust chamber 67 is of an enlarged size which generally conforms to the space within the engine support housing 24 and permits collection and/or expansion of exhaust gases. The enlarged first chamber 67 then is reduced in size to a second chamber 68 having a tubular shape as shown in FIG. 6. The second chamber 68 is within a depending tubular shaped portion 69 within the engine support housing 24. The depending tubular shaped portion 69 includes side openings 70 connecting between the first and second chambers 67 and 68 as shown in FIG. 5.

The depending tubular shaped portion 69 is sealed within the spindle 33 by seal **69*a*. The spindle 33 forms an upper end portion 71 between the downward trunnion 44 providing an exhaust gas exit 72 from the upper portion of the exhaust system 65 and a tubular lower end portion 73 between the upward trunnion 46 forms an exhaust gas entrance 75 into the lower portion of the exhaust system 65. The driveshaft housing assembly 13 includes a flexible cover or exhaust bellows 75 which extends between the upper end portion 72 and the lower end portion 73 to provide a third chamber 76 therebetween. The third chamber 76 formed by the exhaust bellows 75 which surrounds the universal joint bellows 64 as well as a portion of the upper and lower drive shafts 52 and 53 as shown in FIG. 3 also is of a generally tubular shape. The exhaust bellows 75 is a resilient tubular connector which is slipped over the end portions 71 and 73 and fastened thereto by a hose clamp 77. The third chamber 76 provides an exhaust gas passageway between the exhaust bellows 75 and the universal joint bellows 64** which flexes with trim/tilt.

The lower unit adapter 38 which detachably mounts on the lower unit 14 includes the tubular lower end portion 74. A fourth chamber 78 also of generally tubular shape is between the driveshaft bearing lower support 62 and the tubular lower end portion 73. The fourth chamber 78 enlarges into a fifth chamber 79.

The lower unit adapter 38 forms a cover over the lower unit 14. The fifth chamber 79 is formed between the lower unit adapter 38 and within the lower unit 14. The fifth chamber 79 generally conforms to the shape of the lower unit 14 and opens into a central exhaust passageway 80 within the propeller 57 as shown in FIG. 3.

The fifth exhaust chamber 79 extends between the fourth chamber 78 and the propeller exhaust passageway 80. The fifth exhaust chamber 79 is believed to be not critical in size as long as it is of sufficient size to satisfy the back pressure to the particular engine 12. In the embodiment of FIG. 3, the exhaust gases are believed to project rearward of the propeller 57 into the water. The large arrowed lines E-E shown in FIG. 3 schematically illustrates the exhaust path through the exhaust system 65.

The L-Drive also includes a shift assembly 85 (partly shown in FIG. 3) for operating the clutch (not shown) in the lower unit 23 and an engine water cooling system including a driveshaft driven pump (not shown). The engine water cooling system as is known generally picks up water with a driveshaft pump, circulates it through the engine and expels the water. FIGS. 3 and 4 show a set of very small water inlets 86 which introduce water into the driveshaft housing 13. In other words, a small amount of water which has circulated through the engine enters from the inlets 86 and flows through the exhaust system 65. This water which is of a temperature less than boiling runs along the interior surfaces within the exhaust system 65 cooling and cleaning these surfaces.

Figure 7:
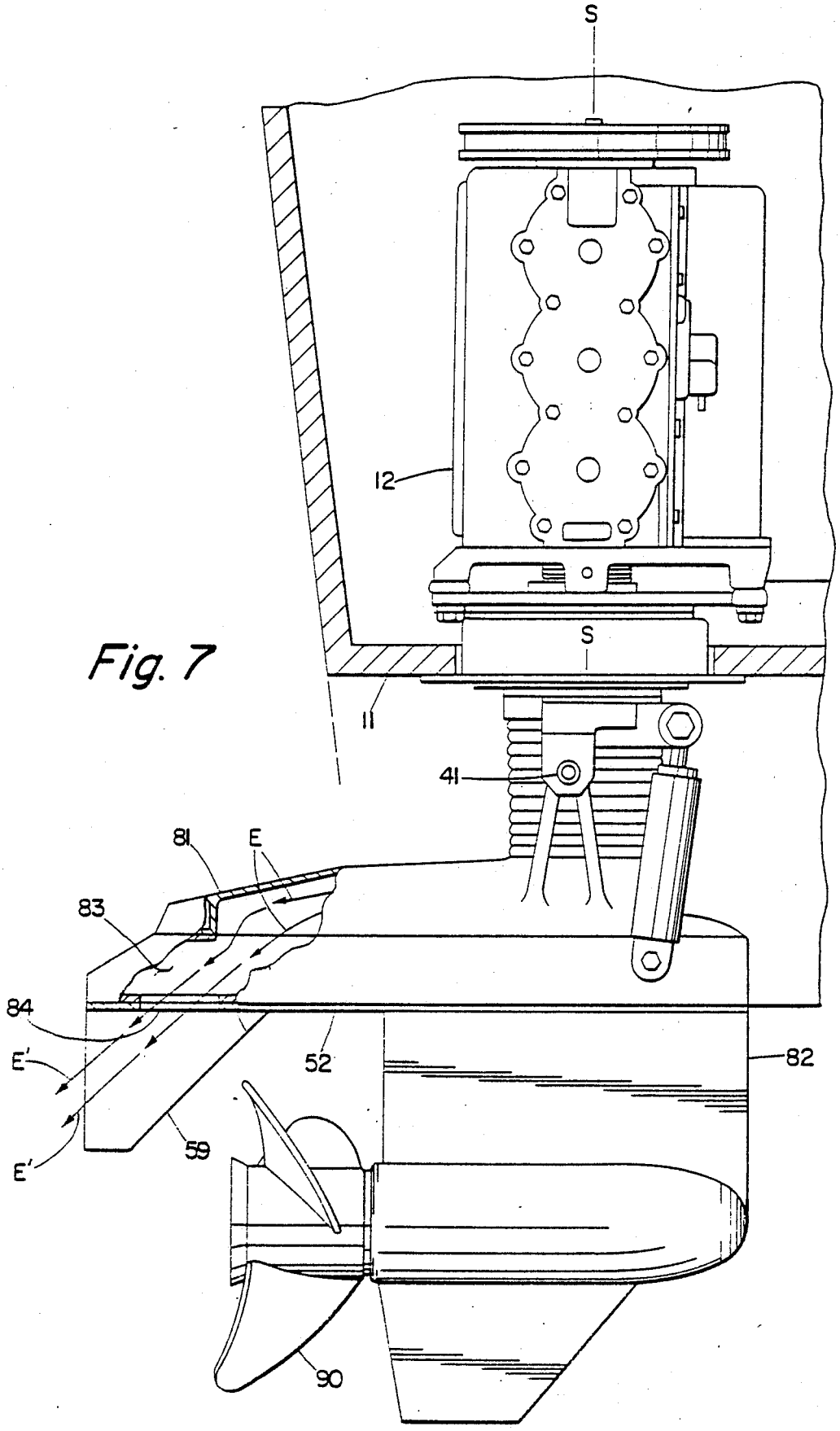
FIG. 7 is a right side elevational view partially in cross section of a second embodiment of the boat propulsion device of the invention.

A second embodiment of the lower portion of the exhaust system 65 is shown in FIG. 7. In the second embodiment the same reference numbers refer to parts generally similar with the first embodiment.

The lower unit adapter 81 forms a cover over the lower unit 82. The lower unit 82 includes a sixth chamber 83 forming a passageway opening to an exhaust gas outlet 84. The exhaust gas outlet 84 exits under the anticavitation plate 58 within the trim fin 59. This known exhaust position is believed to project the exhaust gases rearwardly from the boat into the water. Similar to the first embodiment, the large arrowed lines E-E shown in FIG. 7 schematically illustrates the path of the exhaust gases through the self-containing internal exhaust system 65 of the second embodiment. The lower unit 82 of the second embodiment utilizes a solid hub propeller 90.

Operation of the Steering and Trimming System

Steering and trimming of the L-Drive 10 is easily accomplished. To steer the boat 11, the driver turns the boat steering wheel which operates the boat steering system to turn the lower unit 14. To trim the boat 11, the operator operates the boat hydraulic system to power the hydraulic trim cylinder 48 to lift or lower the lower unit 14. The steering of the lower unit 14 is about the vertical axis S-S and the trimming or tilting of the loer unit 14 is about the horizontal axis T-T. The steering is totally independent from the trimming and tilting. In other words the operator can steer at any trim position and the operator can trim at any steered position.

The steering of the L-Drive 10 is further described with respect to FIGS. 1 through 3. When the steering arm 42 is moved by the steering system of the boat 11, it rotates the spindle 33 within the spindle housing 21 to steer the lower unit 14. Steering the lower unit 14 redirects the propeller thrust. The redirected propeller thrust changes the direction of the boat 11 thereby directing or steering the boat in the desired path.

The trimming of the L-Drive 10 is also described with respect to FIGS. 1 through 3. When the lower unit 14 is being trimmed it swings up-and-down about the horizontal pivot axis T-T. Swinging of the lower unit 14 changes the angle of the propeller thrust direction to lift or lower the bow of the boat. The range of angular direction of the propeller thrust from a boat stopped condition to an on plane condition generally defines the range of trim. The range of tilt is upwardly from the maximum up or out trim position to the highest position available. The tile range is used to change the propeller and to lift the drive 14 when removing the boat 11 from the water on a trailer or for transporting or storage. The propeller thrust is generally not used or available in the tilt range therefore steering does not occur.

Figure 8:
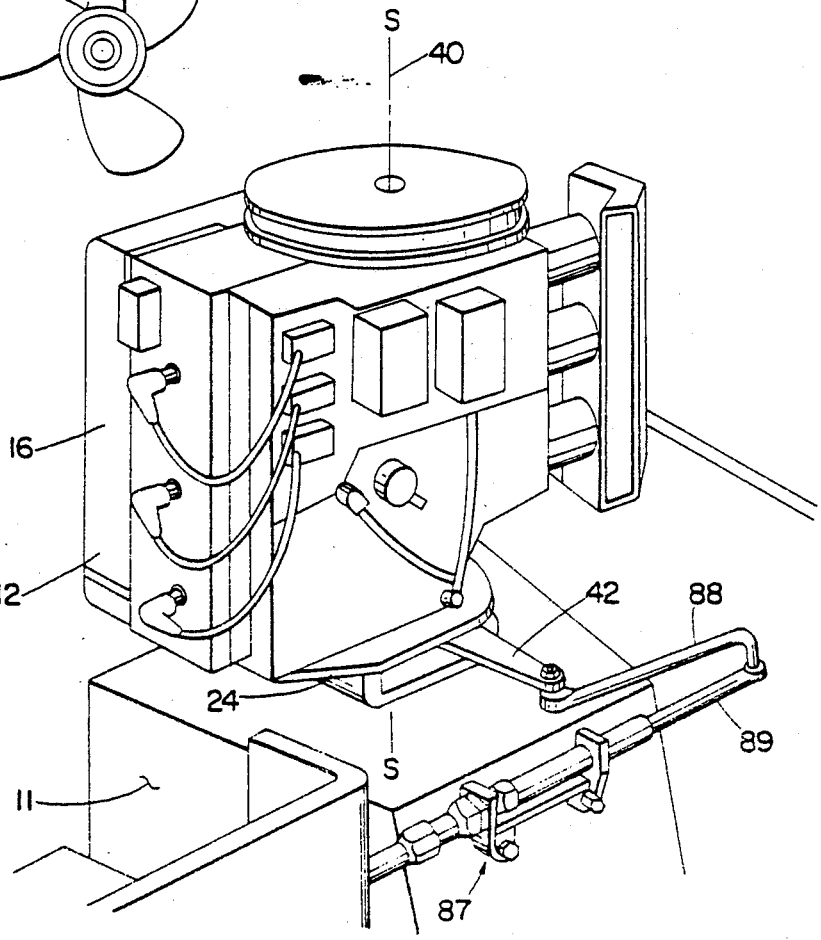

FIG. 8 illustrates the L-Drive 10 connected to the boat steering system 87 (partly shown). The steering arm 42 faces towards the bow of the boat 11 and connects with steering link 88 to the push-pull steering assembly 89. The steering assembly 89 is operated by the boat steering wheel (not shown) as is known. Movement of the steering arm 42 rotates the steering spindle 33 (shown in FIG. 3) to steer the lower unit 14 or 82.

While embodiments and applications of the invention have been shown and described, it would be apparent to those skilled in the art that modifications are possible without departing from the inventive concepts herein. Therefore, the invention is not to be restricted other than by the scope and equivalency of the following claims.

We claim:

1. A marine drive for mounting through a hole in a bottom surface of a boat comprising an engine for positioning inside the boat, a lower unit for driving a propeller, said lower unit positioned under the bottom of the boat, a driveshaft housing assembly between said engine and said lower unit, said drivehshaft housing assembly including a steering assembly having a steering spindle for rotatably steering said lower unit about a generally vertical axis, a trimming system connecting with said steering assembly for providing said lower unit with a limited range of horizontal trimming movement therefrom, a driveshaft means drivably coupling said lower unit to said engine, and an exhaust system including an exhaust passageway connecting between said engine and said lower unit through said driveshaft housing assembly, said driveshaft means including an upper driveshaft, a lower driveshaft and an universal joint connecting said upper and lower shafts, said universal joint being positioned within an universal joint bellows.

2. The marine drive defined in claim 1 wherein said universal joint bellows is positioned within and surrounded by an exhaust bellows, whereby the space between said universal joint bellows and said exhaust bellows forms a portion of said exhaust system.

3. A marine drive for mounting through a hole in a bottom surface of a boat comprising a driveshaft housing assembly including a driveshaft housing, a steering assembly constructed to rotate about a generally vertical axis within said driveshaft housing, a trimming assembly connected to said steering assembly for providing a limited range of horizontal swinging movement therefrom, said trimming assembly including a horizontal pivot means for connecting said trimming assembly with said steering assembly and a trim cylinder means having one end connecting to the drive and the other end connecting to said steering assembly to provide an adjustment for selecting a desired fixed trim position throughout steering range of the drive, a driveshaft means through said driveshaft housing assembly, said driveshaft housing assembly mounting the marine drive within the hole in the boat, an engine mounted to said driveshaft housing assembly, and a lower unit mounted to said driveshaft housing assembly.

4. Apparaus for mounting a marine drive through a hole in a bottom surface of a boat comprising, a driveshaft housing assembly including a driveshaft housing for mounting the marine drive through the hole in the bottom surface of the boat, a steering and trimming assembly within said driveshaft housing, a driveshaft means passing generally vertically through said steering and trimming assembly, said driveshaft means including a first driveshaft extending generally vertically downward within said steering and trimming assembly, a second driveshaft extending generally vertically upward within said steering assembly, and an universal joint connecting between adjacent ends of said first and second drive shafts for transmitting rotation therebetween whereby to permit triming of the marine drive, and an exhaust system passageway through said driveshaft housing.

5. The apparatus defined in claim 4 wherein said universal joint is enclosed with a flexible universal joint enclosure means and said exhaust system passageway includes an exhaust flexible exhaust system enclosure means surrounding said universal joint flexible enclosure means.

6. The apparatus defined in claim 5 wherein said trimming assembly includes horizontal pivot means having two spaced trunnion means, said universal joint enclosure means positioned generally central within said exhaust bellows enclosure means.

7. The apparatus defined in claim 4 wherein said steering assembly provides steering around said first driveshaft, said exhaust system passageway including an exhaust passageway portion extending downwardly through said driveshaft housing assembly adjacent to said second driveshaft.

8. The apparatus defined in claim 4 wherein said exhaust system passageway includes an exhaust passageway portion extending downwardly through said driveshaft housing adjacent to said second driveshaft.

9. A marine drive for mounting through a hole in a bottom surface of a boat comprising an engine for positioning inside the boat, a lower unit for driving a propeller, said lower unit positioned under the bottom surface of the boat, a driveshaft housing assembly between said engine and said lower unit, said driveshaft housing assembly including a steering assembly having a steering spindle for rotatably steering said lower unit about a generally vertical axis, a trimming system connecting with said steering assembly for providing said lower unit with a limited range of horizontal trimming movement therefrom, a driveshaft means drivably coupling said lower unit to said engine, said driveshaft means including an upper driveshaft divably connected through said driveshaft housing assembly, said upper driveshaft positioned downwardly through a driveshaft passageway including a portion extending downwardly along said upper driveshaft within said steering spindle, aand an exhaust system including an exhaust passageway connecting between said engine and said lower unit through said driveshaft housing assembly.

10. The marine drive defined in claim 9 wherein said upper driveshaft and said steering spindle are concentrically positioned for relative rotation within said driveshaft housing assembly, said exhaust system passageway including a portion between said upper driveshaft and said steering spindle.

11. The marine drive defined in claim 10 wherein said steering assembly and said trimming system have a common passageway forming a portion of the exhaust system.

12. The marine drive defined in claim 11 further including an upper exhaust passageway end portion depending from said steering assembly, a lower exhaust passageway end portion extending upwardly from said lower unit, and an exhaust bellows flexible enclosure sealably connected between said upper end ortion and said lower end portion.

* * * * *